US007188399B2

(12) United States Patent
Campus et al.

(10) Patent No.: US 7,188,399 B2
(45) Date of Patent: Mar. 13, 2007

(54) METHOD OF FITTING FLUSH GLAZING

(75) Inventors: Emigliano Campus, Yves Bourg (FR); Christophe Pailler, Salles sur Mer (FR)

(73) Assignee: Alstom, Levallois-Perret (FR)

( * ) Notice: Subject to any disclaimer, the term of this patent is extended or adjusted under 35 U.S.C. 154(b) by 96 days.

(21) Appl. No.: 10/937,775

(22) Filed: Sep. 10, 2004

(65) Prior Publication Data

US 2005/0066506 A1 Mar. 31, 2005

(30) Foreign Application Priority Data

Sep. 11, 2003 (FR) ..... 03 50524

(51) Int. Cl.
*B23P 11/00* (2006.01)
*B06J 1/10* (2006.01)

(52) U.S. Cl. ..... 29/428; 296/146.15; 52/204.593; 52/786.1; 52/786.12

(58) Field of Classification Search ..... 29/428, 29/525.01; 52/204.593, 204.597, 204.62, 52/204.68, 204.705, 786.1, 786.11, 786.12; 296/146.15, 218

See application file for complete search history.

(56) References Cited

U.S. PATENT DOCUMENTS 1,534,434 A * 4/1925 Wiberg ..... 49/388
2,107,775 A * 2/1938 Axe ..... 52/204.593
2,925,050 A * 2/1960 Candlin, Jr. et al. ..... 105/397
4,138,155 A * 2/1979 Chrysler ..... 296/218
4,295,305 A * 10/1981 Shelver ..... 52/172
4,513,548 A * 4/1985 Parker ..... 52/202
4,616,456 A * 10/1986 Parker ..... 52/202
4,821,394 A * 4/1989 Martinez-Vera ..... 29/401.1
5,809,707 A * 9/1998 Bargados et al. ..... 52/204.62
6,425,215 B2 * 7/2002 Farrar ..... 52/204.5
6,492,028 B2 * 12/2002 Kotera et al. ..... 428/424.8
2001/0032422 A1 * 10/2001 Farrar ..... 52/204.5

FOREIGN PATENT DOCUMENTS

DE 34 38 516 A 4/1986
EP 0 398 077 A 11/1990
EP 581746 A1 * 2/1994
EP 0 895 890 A 2/1999

* cited by examiner

*Primary Examiner*—Jermie E. Cozart
(74) *Attorney, Agent, or Firm*—Sughrue Mion, PLLC

(57) ABSTRACT

In the disclosed method of fitting a fixed flush glazed window of a high-speed rail vehicle, a first edge of the window is first placed from the exterior of the vehicle in a groove situated on a horizontal portion of the window frame, after which the window is tilted to move the opposite second edge of the window toward the opposite horizontal portion of the window frame, and finally the opposite second edge is fixed to the opposite horizontal portion of the window frame from inside the vehicle. Thus there is no mechanical fixing to the horizontal portion of the window where the groove is located, so that it is no longer necessary to demount all of the interior fittings when changing a window, while fixing the other horizontal portion from the inside minimizes the width of the mastic. Furthermore, installation from the outside means that the window may be fitted independently of the position of the vehicle on the assembly line, since whether the interior fittings have been fitted or not is of no importance.

8 Claims, 3 Drawing Sheets

METHOD OF FITTING FLUSH GLAZING

BACKGROUND OF THE INVENTION

1. Field of the Invention

The present invention relates to fitting and fixing a window to a high-speed rail vehicle.

2. Description of the Prior Art

To improve their aerodynamics, rail vehicles are made with the fewest possible sharp edges, and are therefore equipped with flush glazing units that do not project from and are not set back from the exterior face of the vehicle body. A finish mastic seal is inserted into the space between the external face of the glazing unit and the window opening in the vehicle body.

At present such windows are fitted:

from inside the vehicle, which reduces the width of the bead but necessitates demounting of the interior fittings to replace a window, or from outside the vehicle, which facilitates window replacement, because it is not necessary to demount the interior fittings, but makes it necessary to insert a wide bead of mastic, which increases the maintenance down-time, or by installing a window pier between two window glazing units, which makes it necessary to use a greater number of parts and therefore increases fitting time on the assembly line and the number of parts in the inventory.

The fitting method of the invention reduces the width of the mastic, reduces the number of parts, and minimizes the number of fittings to be demounted during maintenance, which reduces the vehicle down time.

SUMMARY OF THE INVENTION

In a method according to the invention of fitting a fixed flush glazed window of a high-speed rail vehicle, a first edge of the window is first placed from the exterior of the vehicle in a groove situated on a horizontal portion of the window frame, after which the window is tilted to move the opposite second edge of the window toward the opposite horizontal portion of the window frame, and finally the opposite second edge is fixed to the opposite horizontal portion of the window frame from inside the vehicle. Thus there is no mechanical fixing to the horizontal portion of the window where the groove is located, so that it is no longer necessary to demount all the interior fittings when changing a window, and fixing the other horizontal portion from the inside minimizes the width of the mastic. Also, installation from the outside means that the window may be fitted independently of the position of the vehicle on the assembly line, since whether the interior fittings have been fitted or not is of no importance.

In one variant, the groove is in the lower portion of the frame. The low position of the groove means that the fixings are situated in the upper portion of the window so that at replacement time it suffices to open the articulated voussoir to obtain access to the mechanical fixings of the window.

According to one particular feature, the window is double glazed. Double glazing provides better thermal and acoustic insulation.

According to a complementary feature, the double glazing comprises a tempered pane associated with a laminated pane. The use of tempered glass on the passenger compartment side reduces the cost of double glazing.

According to another complementary feature, the width of the laminated pane is greater than that of the tempered pane.

The laminated glass therefore covers approximately half the window upright on each side (half-pier), which ensures the continuity of the glazing. The pier panes are therefore not needed, which reduces the number of parts in the inventory and optimizes the fitting time.

According to another feature, the height of the laminated pane is greater than that of the tempered pane.

According to another feature, the double glazing is assembled by adhesive bonding to a false frame consisting of two horizontal sections and two vertical sections. There is therefore no mechanical connection between the horizontal sections and the vertical sections. This design is a simple one and reduces the cost of the frame.

According to a complementary feature, the glazing unit is fixed to the vertical portions of the window from the inside, if the horizontal fixings are sufficient to support loads in service, in particular in the event of high pressure variations, as when two high-speed trains pass each other in a tunnel.

The invention will be better understood after reading the following description which is given by way of example only and with reference to the appended drawings.

DETAILED DESCRIPTION OF THE PREFERRED EMBODIMENT

Figure 1:
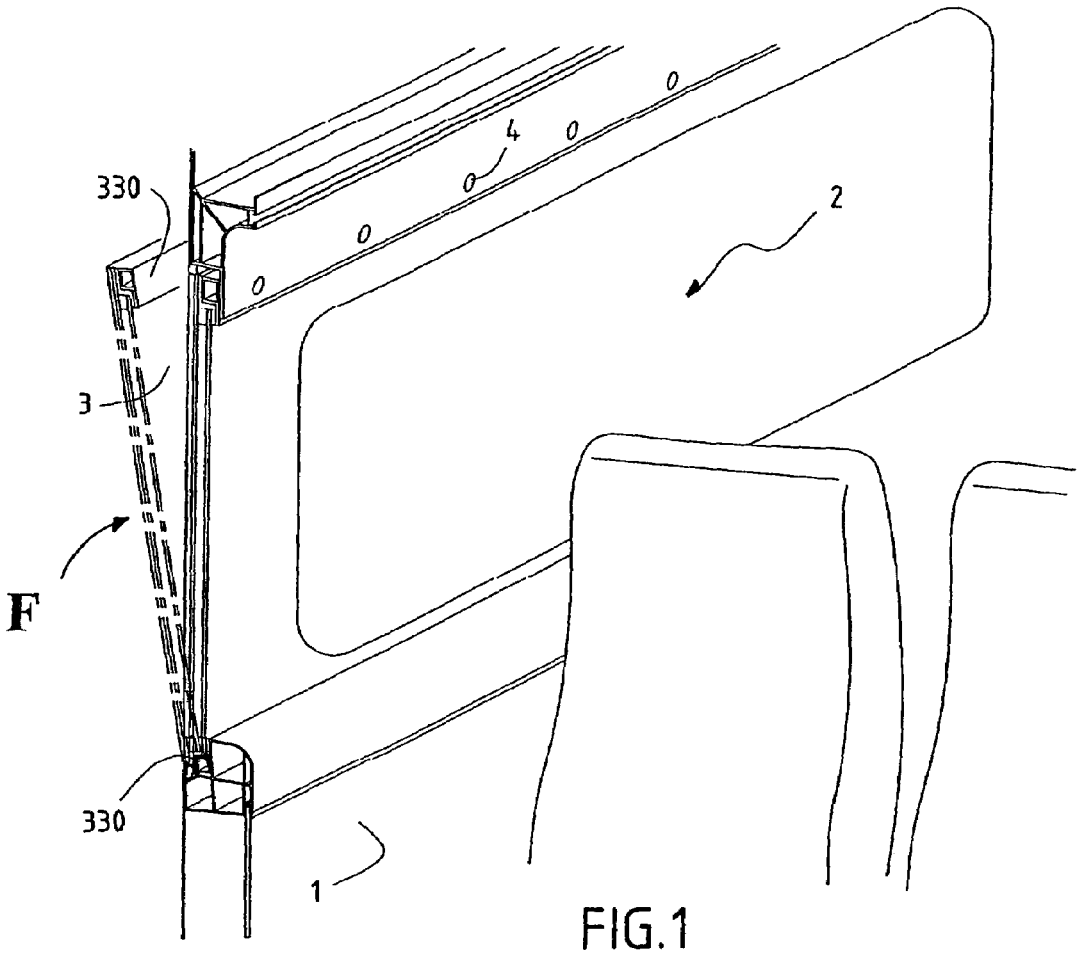
FIG. 1 is a perspective view of a window according to the invention.
Figure 4:
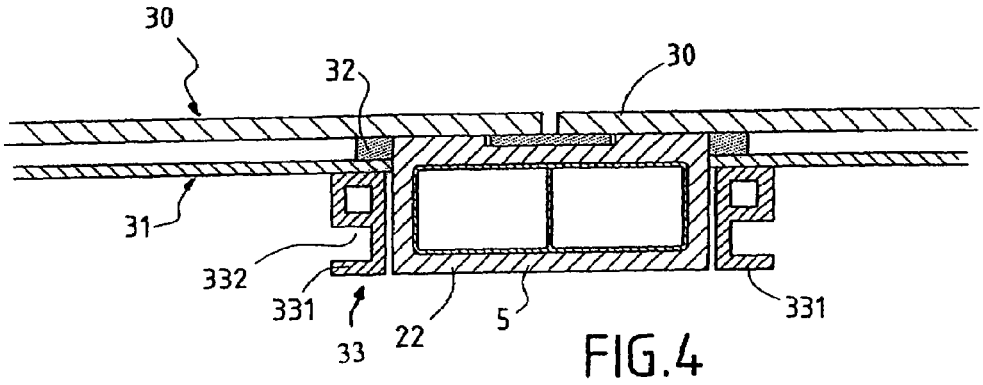
FIG. 4 is a view in section of a window pier according to the invention.

Train windows consist of a window opening 2 in the body 1 and a window comprising a glazing unit 3 and a frame 33, as may be seen in FIGS. 1 and 4.

The glazing unit 3 comprises two panes, namely a pane 30 of tempered or annealed laminated glass and a pane 31 of tempered glass. The laminated pane 30 is on the outside (see FIGS. 2, 3 and 4) and is fixed to the pane 31 in the conventional way by an adhesively bonded seal 32 between the two panes 30 and 31. The panes 30 and 31 are bonded to a false frame 33 consisting of two horizontal sections 330 and two vertical sections 331. The combination of the two panes 30 and 31, the seal 32 and the false frame 33 constitutes the window.

Figure 2:
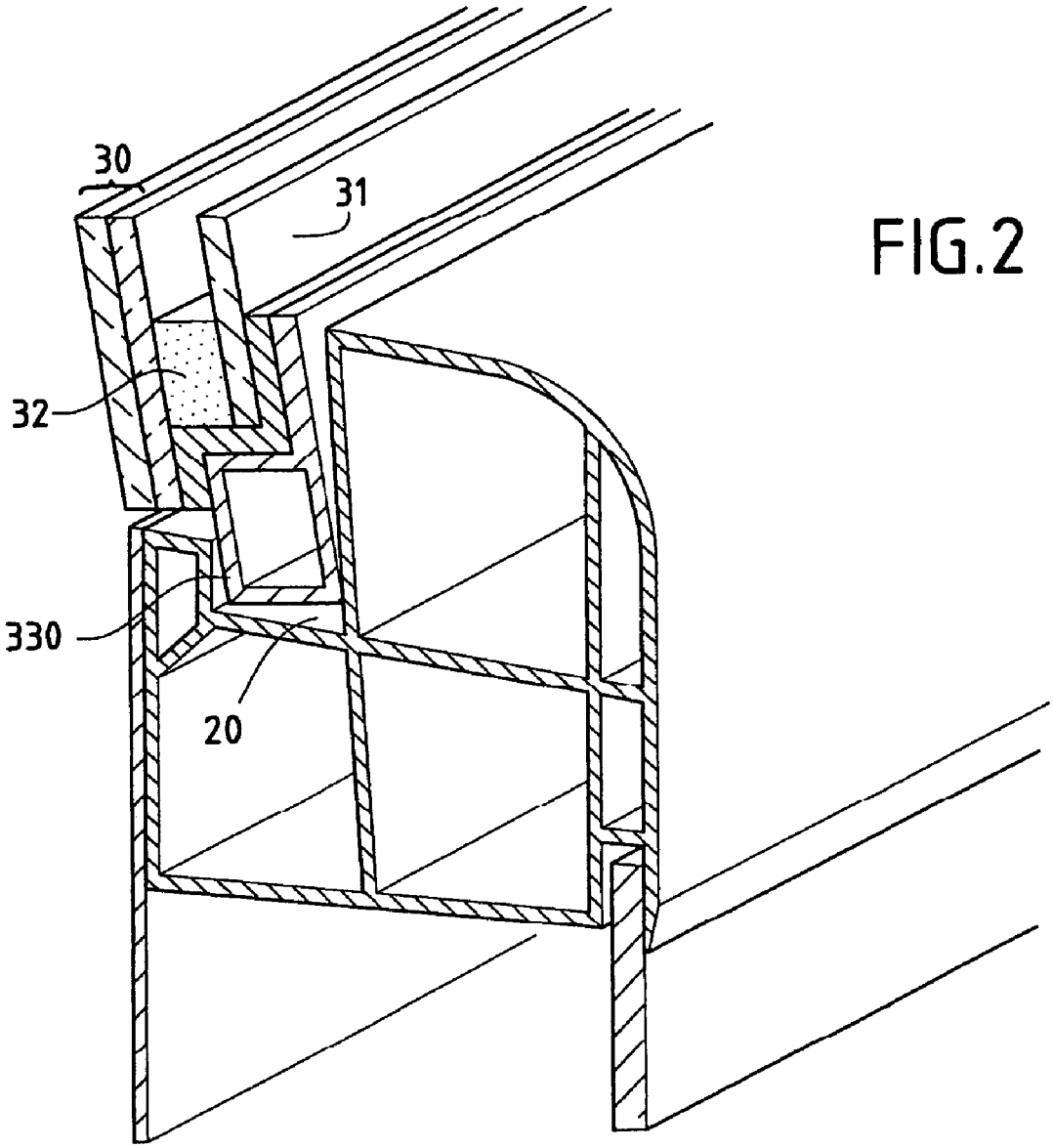
FIG. 2 is a detailed view of the bottom of a window of the invention.
Figure 3:
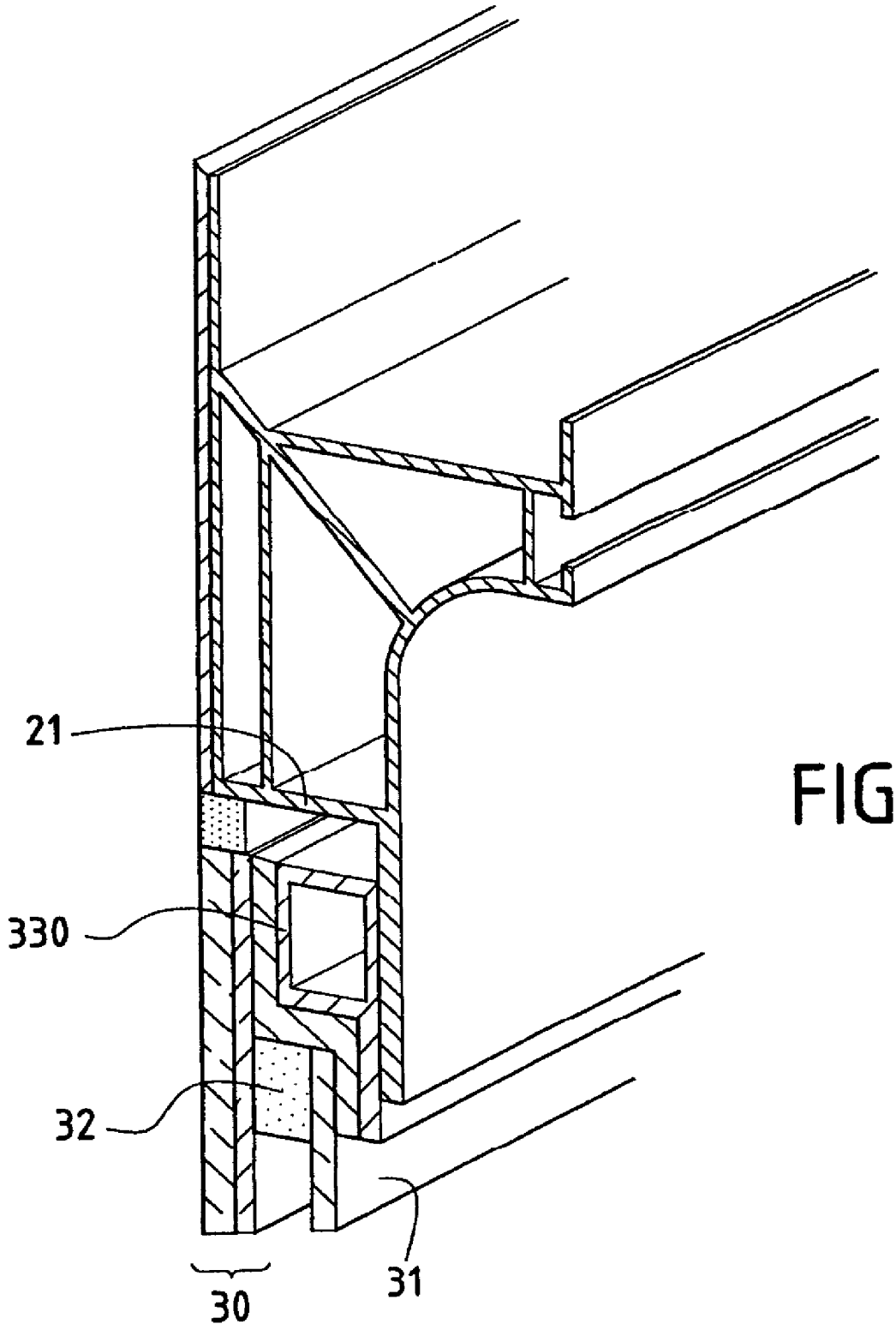
FIG. 3 is a detailed view of the top of a window of the invention.

To fit the window 3, the horizontal section 330 is inserted into a groove 20 of the window opening 2 (as shown in FIG. 2), after which the window is tilted in the direction F, toward the body 1 (see FIG. 1), in order to bring the horizontal section 330 into contact with the top 21 of the window opening 2 (see FIG. 3). The assembly is then fixed by conventional fixing means 4 (as shown in FIG. 1). Mastic is then applied between the top 21 of the window opening 2 and the of the window to seal the connection (as shown in FIG. 3).

The laminated pane 30 is taller and wider than the tempered pane 31, as may be seen in FIG. 4. The pane 30 covers half of the window pier 5 of the body 1, the other half being covered by the pane 30 of the next window. The exterior profile of the vehicle therefore has a continuous line of flush glazing units.

The vertical sections 331 of the false frame 33 comprises a recess 332 that constitutes a guide rail for the window blind (not shown).

The invention claimed is:

1. A method of fitting a fixed flush glazed window of a high-speed rail vehicle, the method comprising:

placing, from an exterior of said vehicle, a first edge of said window in a groove of a window frame of said vehicle, tilting said window, via said first edge that is placed in said groove, towards said vehicle, such that a second edge of said window, which opposes said first edge, contacts with a portion of said window frame that opposes said groove of said window frame, and fixing, on an interior of said vehicle, said second edge of said window to said portion of said window frame that opposes said groove of said window frame.

2. The fitting method claimed in claim 1, wherein said groove is disposed at a lower portion of said window frame.

3. The fining method claimed in claim 1, wherein said window is double glazed.

4. The fitting method claimed in claim 3, wherein said double glazed window is assembled by adhesive bonding to a false frame consisting of two horizontal sections and two vertical sections.

5. The fitting method claimed in claim 3, wherein said double glazed window comprises a tempered pane associated with a laminated pane.

6. The fitting method claimed in claim 5, wherein a width of said laminated pane is greater than a width of said tempered pane.

7. The fitting method claimed in claim 5, wherein a height of said laminated pane is greater than a height of said tempered pane.

8. The fitting method claimed in claim 1, wherein said window is fixed to vertical portions of a window pier from the interior of said vehicle.

* * * * *